United States Patent [19]

Terrasse et al.

[11] Patent Number: 4,823,451

[45] Date of Patent: Apr. 25, 1989

[54] FORGED COLD-ROLLING ROLL

[75] Inventors: Joseph J. Terrasse, Pont Salomon; Michel Seux, Le Chambon; Robert Leveque, Firminy, all of France

[73] Assignee: Chavanne Ketin, Puteaux, France

[21] Appl. No.: 166,800

[22] Filed: Mar. 3, 1988

Related U.S. Application Data

[63] Continuation-in-part of Ser. No. 882,252, Jul. 7, 1986, abandoned.

[30] Foreign Application Priority Data

Jul. 8, 1985 [FR] France ..... 85 10426

[51] Int. Cl.[4] ..... B21B 27/00

[52] U.S. Cl. ..... 29/129.5; 29/132

[58] Field of Search ..... 29/129.5, 130, 132; 72/67, 184

[56] References Cited

U.S. PATENT DOCUMENTS 3,530,703 9/1970 Shimegi et al. ..... 29/132

FOREIGN PATENT DOCUMENTS

A539190 7/1955 Belgium .
1262612 3/1968 Fed. Rep. of Germany .
3006512 11/1981 Fed. Rep. of Germany .

OTHER PUBLICATIONS

"Multiplying Factors of the Calculation of Hardenability of Hypereutectoid Steels Hardened from 1700° F.", C. F. Jatezack and D. J. Girardi, transactions of ASM 1959–51, p. 335.

"Hardenability of High Carbon Steel", C. F. Jatezack and D. J. Girardi, Metallurgical Transaction, vol. 4, Oct. '73, p. 2267.

*Primary Examiner*—Howard N. Goldberg
*Assistant Examiner*—Irene Cuda
*Attorney, Agent, or Firm*—Cushman, Darby & Cushman

[57] ABSTRACT

The roll is made from a low alloy steel having the following composition by weight : C: 0.76 to 0.92; Mn: 0.70 to 1.40; Si: 0.70 to 1.40; S≦0.020; P≦0.025; Ni≦0.60; Cr: 1.50 to 2.20; Mo: 0.15 to 0.55; V: 0.08 to 0.25; Cu≦0.50; the remainder being iron and accidental impurities.

2 Claims, 2 Drawing Sheets

RCH
65
60
55
50
45
steel of the invention
Prior art steel
D

J distance for RCH = 60
70
60
50
40
30
20
10
Si (Mo 0,45)
Si (Mn 0,6)
Mn
Mo
Si (Mo 0,25)
0,5
1
1,5 % element

FORGED COLD-ROLLING ROLL

This is a continuation-in-part of application Ser. No. 882,252, filed July 7, 1986, which was abandoned upon the filing hereof.

BACKGROUND OF THE INVENTION

The present invention relates to forged rolls for cold rolling and more particularly to working rolls for rolling iron and steels, non-ferrous metals and their alloys at temperatures lower than or equal to 100° C. and possibly to backing rolls used in multi-roll rolling mills.

In order to ensure excellent endurance in service at the lowest cost and working rolls must have a number of characteristics in the state of utilization, namely:

1. A high surface hardness of between 90 and 105 Shore C according to the products to be rolled.

2. Great depth of the hardened layer which will permit limiting, or even eliminating, retreatments which may be necessary for maintaining the desired hardness throughout the given depth of utilization of the roll.

3. High resistance to wear by abrasion.

4. A controlled content of residual austenite of the hardened layer; it being understood that excessively high contents of residual austenite are harmful in that they promote cracking under service stress.

5. A dendritic structure of the surface layers which is sufficiently homogeneous in order to avoid a phenomenon of an extremely fine pitting of the sheet which is given the name of "toad skin" or "orange peel" in the profession.

A large number of these characteristics may be regulated by a judicious choice of the conditions of manufacture of the cold-rolling rolls and more particularly of the heat treating operations: tempering whereby it is possible to adjust the hardness of the body of the roll, conventional hardening method with heating to a temperature>AC3 of the whole of the roll during the austenitization, surface hardening after heating to a temperature>AC3 solely of a relatively thin layer, more or less well adjusted cooling conditions.

However, the choice of the grade remains primordial for optimizing the required characteristics at the lowest cost.

The grades used at the present time for cold-rolling working rolls of water-hardened forged steel comprise 0.8 to 0.9% carbon, 1.8 to 3.0% chromium and other alloy elements and are illustrated by the conventional grade 83 CDV7 which has in fact a sufficiently high content of carbon to obtain the required high levels of hardness, the contents of Cr, Mo, V are sufficient to obtain a correct hardenability and the formation of many carbides ensuring good wear resistance. With conventional heat treatments followed by an energetic water quenching it is thus possible to obtain easily a surface hardness of 103 Shore C, a depth of 15 mm of a hardened layer having a hardness of ≧85 Shore C on rolls having a roll body surface diameter of 550 to 650 mm.

With a surface hardening after induction heating at the frequency of 50 Hz, similar surface hardnesses are obtained with however a hardened layer of greater depth, namely about 22 mm.

However, in order to take full advantage of the useful depth of the roll body surface, such hardened depths require a minimum of two retreatments.

These retreatments are expensive and many manufacturers have sought to improve the hardenability of the steel so as to obtain hardened layers having a depth of about 30 mm, which then limits the number of retreatments to a single operation.

In order to increase this depth, attention has been directed to more highly alloyed steels having contents of Cr ranging up to 3% and of Mo up to 0.5%. Apart from the fact that these alloy elements are expensive, the increase in their content has the serious drawback of producing an undesirable amount of residual austenite after the martensitic quenching.

Large amounts of residual austenite may be remedied by a treatment subsequent to the quenching consisting in plunging the roll into liquid nitrogen (sub-zero treatment), but these treatments are delicate to carry out and costly.

Lastly, the increase in the content of the alloy elements Cr, Mo, V results in a banded structure and a dendritic structure which impair the surface quality of the rolled products.

SUMMARY OF THE INVENTION

An object of the present invention is to overcome these drawbacks while providing forged rolls having a hardened layer of great depth.

The invention also provides a cold-rolling forged roll made from a low alloy steel which has the following composition by weight:

C: 0.76 to 0.92; Mn: 0.70 to 1.40; Si: 0.70 to 1.40; S≦0.020; P≦0.025; Ni≦0.60; Cr: 1.50 to 2.20; Mo: 0.15 to 0.55; V: 0.08 to 0.25; Cu≦0.50; the remainder being iron and accidental impurities.

The essential characteristic of the invention resides in the content of Si which produces, in association with the Mn, a synergic effect on the hardenability of a steel having a low content of alloy element, and in particular Mo.

DETAILED DESCRIPTION

The works of Jatezack and Girardi in the following articles:

Multiplying factors of the calculation of hardenability of Hypereutectoid steels Hardened from 1,700° F.; C. F. Jatezack and D. J. Girardi transactions of ASM 1959–51 p 335; and Hardenability of high carbon steel; C. F. Jatezack and D. J. Girardi Metallurgical transaction—vol 4 Oct. 73 p 2267;

describe the effect of alloying elements on the hardenability of hypereutectoid steels and characterize the hardenability of the various grades by the distance from the quenched end of the Jominy point where the hardness is 63 RCH or Jominy test specimens austenitized at temperatures between ACm+50 and ACm+100.

The structure corresponding to the hardness of 63 RCH is almost completely martensitic with a maximum of 10% bainite, so that the criterion adopted is quite representative of the conditions of utilization of the rolls.

Figure 1A:
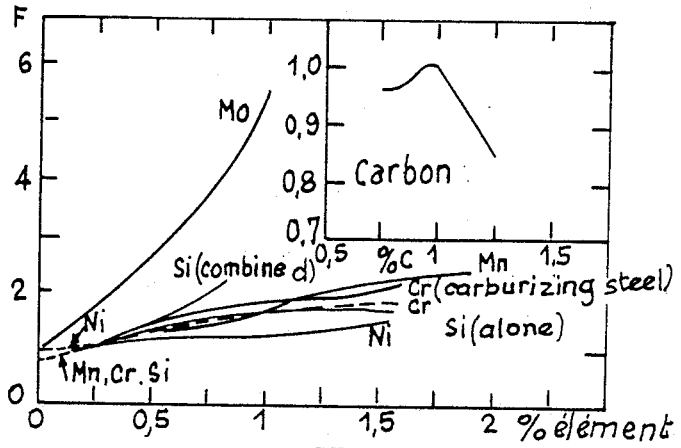
FIGS. 1*a* and 1*b* are graphs illustrating the multiplying factor F on the distance from the quenched end as a function of the content of various indicated elements for a respectively normalized and annealed initial structure.
Figure 1B:
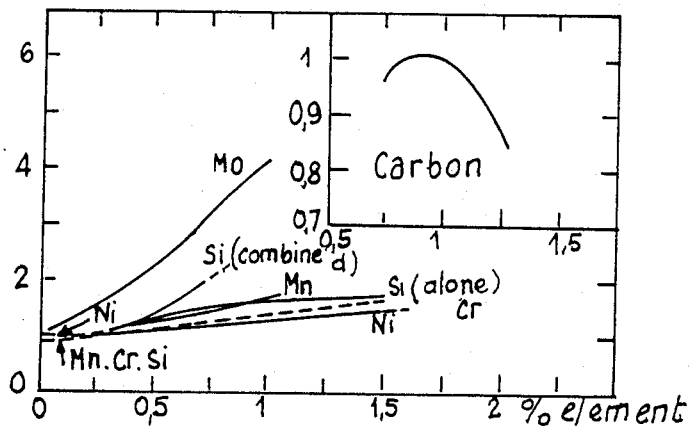

These works show that the heardenability can be increased by using higher contents of conventional alloying elements such as Mn, Ni, Cr, V, Si, and above all Mo as indicated by the graphs of FIGS. 1*a* and 1*b* illustrating the multiplying factor F on the distance from the quenched end as a function of the content of various indicated elements for a respectively normalized and annealed initial structure.

It is quite clear from these graphs that Mo has the greatest effect and in particular an effect greater than Si alone or even combined and greater than Mn.

Now, the applicant has discovered that in contrast to the teachings of these works, Mo has an effect on the hardenability which has a maximum for relatively small contents.

Figures 2, 3:
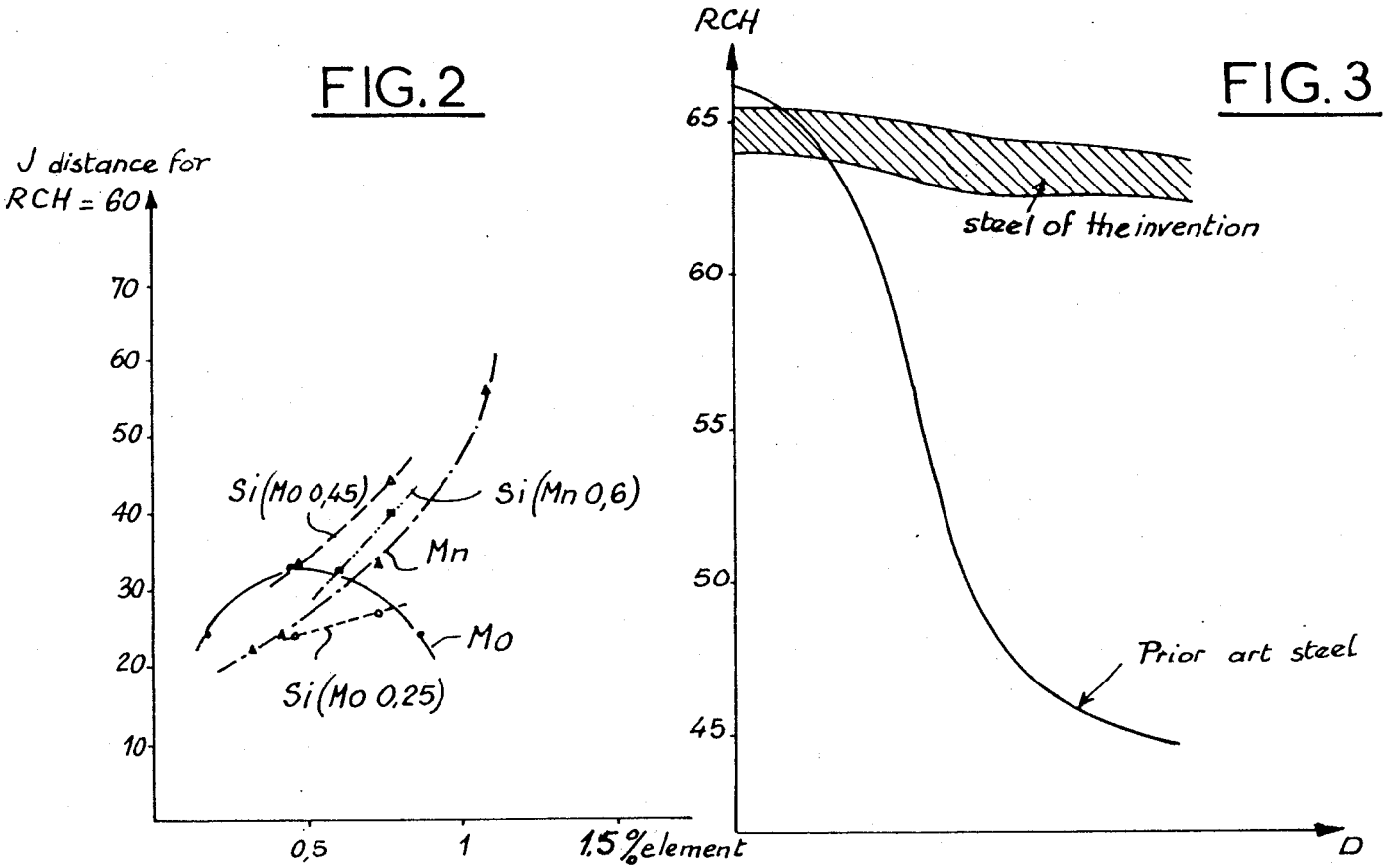
FIG. 2 is a graph showing the effect of the addition of elements Mo, Mn and Si on the hardenability of a steel 85 CDV7 which had been subjected to an austenitization treatment ACm+60° C.
FIG. 3 is a graph showing hardness as a function of the distance D to the quenched end Jominy curves for a conventional grade of 85 CDV7 steel in comparison with those for a range of steel grades according to the invention.

These results are given in FIG. 2 which shows graphically the effect of the addition elements Mo, Mn and Si on the hardenability of a steel 85 CDV7 which had been subjected to an austenitization treatment Acm+60° C. In this graph, plotted as ordinates is the Jominy distance, i.e. the distance in mm to the end of a normalized test specmen (having a diameter of 25 mm) in respect of which the Rockwell C hardness (RCH) is higher than or equal to 60.

Further, it is clear that Si has a synergic effect on Mo and above all on Mn.

As a comparison, FIG. 3 shows (hardness as a function of the distance D to the quenched end) Jominy curves for a conventional grade which is a steel 85 CDV7 whose contents of Mn are 0.25 and Si 0.42 and for a range of steel grades according to the invention.

The increase in the hardness at 70 mm from 45 RCH to 63 RCH is particularly significant.

Further, the presence of silicon tends to promote the formation of carbides which is advantageous for the wear resistance as has been shown by the various laboratory tests carried out.

On the other hand, there is observed a slight decrease in the carbon content of the matrix of the steel and consequently in the maximum hardness level which may be obtained: this is not a drawback, since it is sufficient to act on the tempering conditions after quenching between 100° and 200° C.

The silicon moreover increases the resistance to tempering. Its action can therefore only be beneficial when small rolling incidents occur resulting in an increase in the superficial temperature of the rolls.

The absence of a significant influence of the additions of Mn and Si on the residual amount of austenite after treatment and on the tensile strength of the metal treated at the level of 64 RCH, has been confirmed in the range of the chosen contents. The same is true in respect of the dendritic structure on the roll body surfaces. The conjugate addition of manganese and silicon has been found to be beneficial for the performance of the roll in service.

The following examples are given as an illustration of the invention.

EXAMPLE 1

There is made a working cylinder having a roll body surface diameter of 3.25 mm and a roll body surface length of 1324 mm with a roll body surface hardness of 760 Vickers, namely 92 Shore C, intended for the cold rolling of rolls of silicon steel.

This roll is machined from a blank forged from a steel ingot having the following composition:

C 0.83—Mn 1.12—Si 0.89—S 0.009—P 0.012—Ni 0.33—Cr 1.82—Mo 0.25—V 0.11.

The final treatment of the roll body surface is carried out by a low frequency (50 Hz) surface heating and quenching in water.

In this way, a 28.5 mm deep hardened layer is obtained.

As a comparison, a similar roll was made from the conventional grade:

C 0.83—Mn 0.29—Si 0.33—S 0.007—P 0.014—Ni 0.27—Cr 1.77—Mo 0.24–V 0.11.

This roll has, after a low frequency surface hardening, a 20.5 mm deep hardened layer.

Thus, by means of the invention, there is obtained an increase of 40% of the depth of the hardened layer in a less expensive grade from the point of view of both the constituent elements and the process of manufacture.

The rolls in the grade of steel according to the invention used in a reversible 4-high rolling mill have permitted the rolling of 3,690 metric tons instead of 3,100 metric tons for the comparison grade, namely an increase of 19%.

EXAMPLE 2

There is made a working roll for cold rolling automobile body sheet metal having the following characteristics:

diameter of the roll body surface: 535 mm
length of the roll body surface: 1676 mm
intended roll body surface hardness: 830 VH.
Composition of the metal: C 0.86—Mn 0.96—Si 1.19—S 0.004—P 0.012—Ni 0.175—Cr 1.66—Mo 0.22—V 0.096.

The final treatment of the roll body surface is carried out as in Example 1.

After detensioning and before adjustment of the hardness, the surface hardness is 875 VH.

The hardened depth, corresponding to a hardness of 700 VH, namely substantially 85 Shore C, is 29.6 mm.

The useful hardened depth of the rolls being 27 mm, the whole of this depth can be used before scrapping without retreatment by a rehardening of the roll.

With rolls having a conventional grade 83 CDV7 similar to that of Example 1, the depth of the hardened layer after low frequency surface hardening measured under the same conditions, is 22 mm. This requires a retreatment for consummating the whole of the useful depth of the roll.

It will be clear that, in respect of a roll having the same geometric characteristics is before but a roll body surface diameter increased to 581 mm and a useful depth increased to 50 mm, the grade according to the invention limits to one retreatment the total utilization of this depth, whereas it is necessary to effect two retreatments with the comparison grade.

The hardened layer of the rolls according to the invention is at least 27 mm, although it may be greater (28.5 and 29.6 mm having been given as depths of hardened layer in the above examples).

The usual technique for measuring hardness consists in measuring the hardness of the roll in a radial direction.

In the usual practice of the cold rolling, the surface layer of the roll is submitted to a (e.g. 6 hours) and before the roll is used again in the rolling mill. During that maintenance step, the superficial hardness of the roll is measured and the wear of the hardened layer is thus monitored. The superficial hardness must be greater than 85 shore C (or 700 HV). Thus, the depth of the hardened layer is the depth of the zone of the roll where the hardness is at least equal to 85 shore C. Experimentally, it is possible to measure the hardness of a test roll or sample every millimeter in depth, after a grinding operation in the direction of the axis of the roll.

The amounts of Mn, Si and Mo present in the steel of which the roll of the invention is made, is 'balanced' in the sense of being selected to be within the respective recited ranges.

More precisely, the inventors have discovered several facts leading to a new composition:

1. Contrary to the knowledge of the prior art, the Mo content has an optimum effect on the hardenability when limited to a rather low level (<0.5%). Practically, the Mo content must be in the range 0.15–0.55% and preferentially about 0.25%.

2. Si and Mn have a synergic effect by themselves (and with Mo). For example, an addition of a total amount of 0.75% Si+0.75% Mn is more efficient (as far as the hardenability is concerned) than 1.5% Si or 1.5% Mn alone.

3. Si must be limited to 1.5%, as a content greater than 1.5% modifies the form of the carbides in the steel, decreases the wear resistance and increases the embrittlement.

4. Mn must be limited toward 1.5%, principally because of difficulties in the steel making process for higher contents.

An optimal composition of the Mo, Si and Mn content is presently believed to be:

Mo: 0.25%—Si: 1% and Mn 1%

A broader definition of the Mo, Si and Mn content of the presently preferred steel compositon is:

Mo: 0.15–0.55)
Mn: 0.7–1.40) with 0.75<Si/Mn<1.25
Si: 0.7–1.40)

What is claimed is:

1. A forged cold-rolling roll made from a low alloy steel having after quenching a high surface hardness of between 90 and 105 shore C and an improved depth of the hardened layer of at least 27 mm, said alloy steel having the following composition by weight: C: 0.76 to 0.92; S<0.020; P<0.025; Ni<0.60; CR: 1.50 to 2.20; V: 0.08 to 0.25; Cu<0.50 and amounts of Mn, Si and Mo selected in the ranges: 0.70 to 1.40 for Mn; 0.70 to 1.40 for Si and 0.15 to 0.55 for Mo resulting in an improved hardenability, the remainder of the steel being iron and accidental impurities.

2. The forged cold-rolling roll of claim 1, having an Si/Mn ratio in the range 0.75–1.25.

* * * * *